US008529290B2

(12) United States Patent
Chang

(10) Patent No.: US 8,529,290 B2
(45) Date of Patent: Sep. 10, 2013

(54) CONNECTOR APPARATUS HAVING A DETACHABLE MODULE

(76) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 13/480,109

(22) Filed: May 24, 2012

(65) Prior Publication Data

US 2012/0302106 A1 Nov. 29, 2012

(30) Foreign Application Priority Data

May 27, 2011 (TW) ..... 100209680 U

(51) Int. Cl.
*H01R 25/00* (2006.01)

(52) U.S. Cl.
USPC ..... 439/541.5; 439/929

(58) Field of Classification Search
USPC ..... 439/541.5, 620.15–620.25, 929
See application file for complete search history.

(56) References Cited

U.S. PATENT DOCUMENTS

| | | | | |
|---|---|---|---|---|
| 6,010,367 | A * | 1/2000 | Wu | 439/620.23 |
| 6,171,151 | B1 * | 1/2001 | Lu et al. | 439/620.23 |
| 6,702,618 | B1 * | 3/2004 | Hyland et al. | 439/620.23 |
| 7,833,062 | B2 * | 11/2010 | Zhou et al. | 439/620.23 |
| 7,874,874 | B2 * | 1/2011 | Chang | 439/620.01 |
| 7,892,023 | B2 * | 2/2011 | Chang | 439/577 |
| 8,137,137 | B1 * | 3/2012 | Chang | 439/607.07 |
| 8,460,030 | B2 * | 6/2013 | Chang | 439/541.5 |
| 2004/0253849 | A1 * | 12/2004 | Kuribayashi et al. | 439/76.1 |
| 2006/0068615 | A1 * | 3/2006 | Pirner et al. | 439/76.1 |
| 2012/0302106 | A1 * | 11/2012 | Chang | 439/701 |
| 2013/0050959 | A1 * | 2/2013 | Chang | 361/736 |

FOREIGN PATENT DOCUMENTS

TW M403159 U 5/2011

* cited by examiner

*Primary Examiner* — James Harvey
(74) *Attorney, Agent, or Firm* — Chun-Ming Shih; HDLS IPR Services

(57) ABSTRACT

A connector apparatus having a detachable module includes a connector base and a detachable module. The connector base has an insulating body and a plurality of press-contacting terminals. A plurality of grooves are inwardly formed on a rear surface of the insulating body. The press-contacting terminals are correspondingly located in the grooves. A press-contacting portion of each of the press-contacting terminals extends along the upper surface of the insulating body and protrudes out from the upper surface. The detachable module is composed of a circuit board, an integrated circuit electrically connecting to the circuit board and a plurality of connecting pins arranged on the circuit board. When the detachable module is connected to the connector base, the connecting pins are electrically connected to the press-contacting portions, and the mainboard of a computer connected to the connector base can execute the function of the integrated circuit in the detachable module.

19 Claims, 5 Drawing Sheets

CONNECTOR APPARATUS HAVING A DETACHABLE MODULE

BACKGROUND OF THE INVENTION

1. Field of the Invention

The present invention relates to a connector, in particularly to a connector apparatus capable of connecting with at least one detachable module.

2. Description of Related Art

As the electronic industry growing rapidly, nowadays various kinds of electronic devices are used in our daily lives. For inputting commands to control the electronic devices, or transmitting information from one electronic device to another, at least one connector is arranged on a circuit board of the electronic device.

For example, a personal computer usually has a plurality of connectors such as universal serial bus (USB) connectors, external serial advance technology attachment (e-SATA) connectors, RJ-45 connectors, high definition multimedia interface (HDMI) connectors. With the connectors, the personal computer is capable of communicating with external controlling devices and receiving controlling commands, or the personal computer can be connected to another electronic device for mutually transmitting information.

However, in order to avoid using physical transmission line and expand the transmission distance of information, wireless transmission modules are arranged on the novel electronic devices. For example, the wireless transmission module can be radio frequency (RF) module, infrared (IR) module, Bluetooth module, and wireless fidelity (Wi-Fi) module. Information can be transmitted between electronic devices through wireless transmission module, no physical transmission line is needed and the information transmission can be easier.

However, either connector or wireless transmission module will occupy a quite large area on the circuit board. If there are many connectors or wireless transmission module needed to arrange on the circuit board, the size of the circuit board needs to be increased. Sometimes, it will affect the circuit layout of the circuit board and make the production more difficult.

Therefore, a stacked connector apparatus is developed for solving the above problem. A plurality of connectors, wireless transmission module are vertically stacked on the circuit board and consequently they only occupy an area for mounting one connector on the circuit board. Moreover, Taiwan patent M403159 disclosed a wireless transmission module. The wireless transmission module is composed of a insulating body and a transmission module. The insulating body has one or more connecting ports, and a receiving space therein, and the connecting ends of plurality of terminals extend into the receiving space. The transmission module has signal transmission portion, signal processing portion and a plurality of adapting terminals. Therefore, when the transmission module is connected to the insulating body, the press-contacting portions of the adapting terminals can be elastically contacted with the connecting ends of the plurality terminals, so that the transmission module is electrically connected to the terminals of the insulating body.

However, the wireless transmission module of the above wireless transmission apparatus has a circuit unit in the transmission module electrically connected to the signal transmission portion and the signal processing portion. And the circuit unit has a plurality of welding portion for the adapting terminals welded thereto. Thus, the adapting terminals need to be additionally manufactured and then welded to the circuit unit. Such a process is inconvenient and the cost thereof can not be decreased. In addition, since the adapting terminals need to be arranged to contact against the adapting terminals on the insulating body, the adapting terminal needs to be bent and forms a press-contacting surface, such that the thickness of the wireless transmission module can not be decreased.

Therefore, a novel stacked connector apparatus is needed, it can be composed of a plurality of connectors and wireless module as wall as the types of the wireless module can be arbitrary changed and the usability can be increased. Besides, the manufacturing cost can be lowered and the dimensions of the product can be downsized.

SUMMARY OF THE INVENTION

The main objective is to provide a connector apparatus having a detachable module, which has an exchangeable connector base and various kinds detachable module electrically connected to the connector base.

For achieving the above objective, the present invention provides a connector apparatus having a detachable module. The connector apparatus includes a connector base and a detachable module. The connector base has an insulating body and a plurality of press-contacting terminals. A plurality of grooves are inwardly formed on a rear surface of the insulating body. The press-contacting terminals are correspondingly located in the grooves. A press-contacting portion of each of the press-contacting terminals extends along the upper surface of the insulating body and protrudes out from the upper surface. The detachable module is composed of a circuit board, an integrated circuit electrically connecting to the circuit board and a plurality of connecting pins arranged on the circuit board. When the detachable module is connected to the connector base, the connecting pins are electrically connected to the press-contacting portions of each of the press-contacting terminals, and the mainboard of a computer connected to the connector base can execute the function of the integrated circuit in the detachable module.

In comparison, the connector base has a plurality of press-contacting terminals for electrically connecting to different detachable module having different functions. The main board of the computer electrically connecting to the connector base can make connection with the detachable module through the connector base and execute the function of the integrated circuit of the detachable module. Users can arbitrary change the function of the connector, and integrate a specific function to the connector and save the space on the mainboard of the computer and lower the cost of the detachable module and downsize the product.

DETAILED DESCRIPTION OF THE INVENTION

Figure 1:
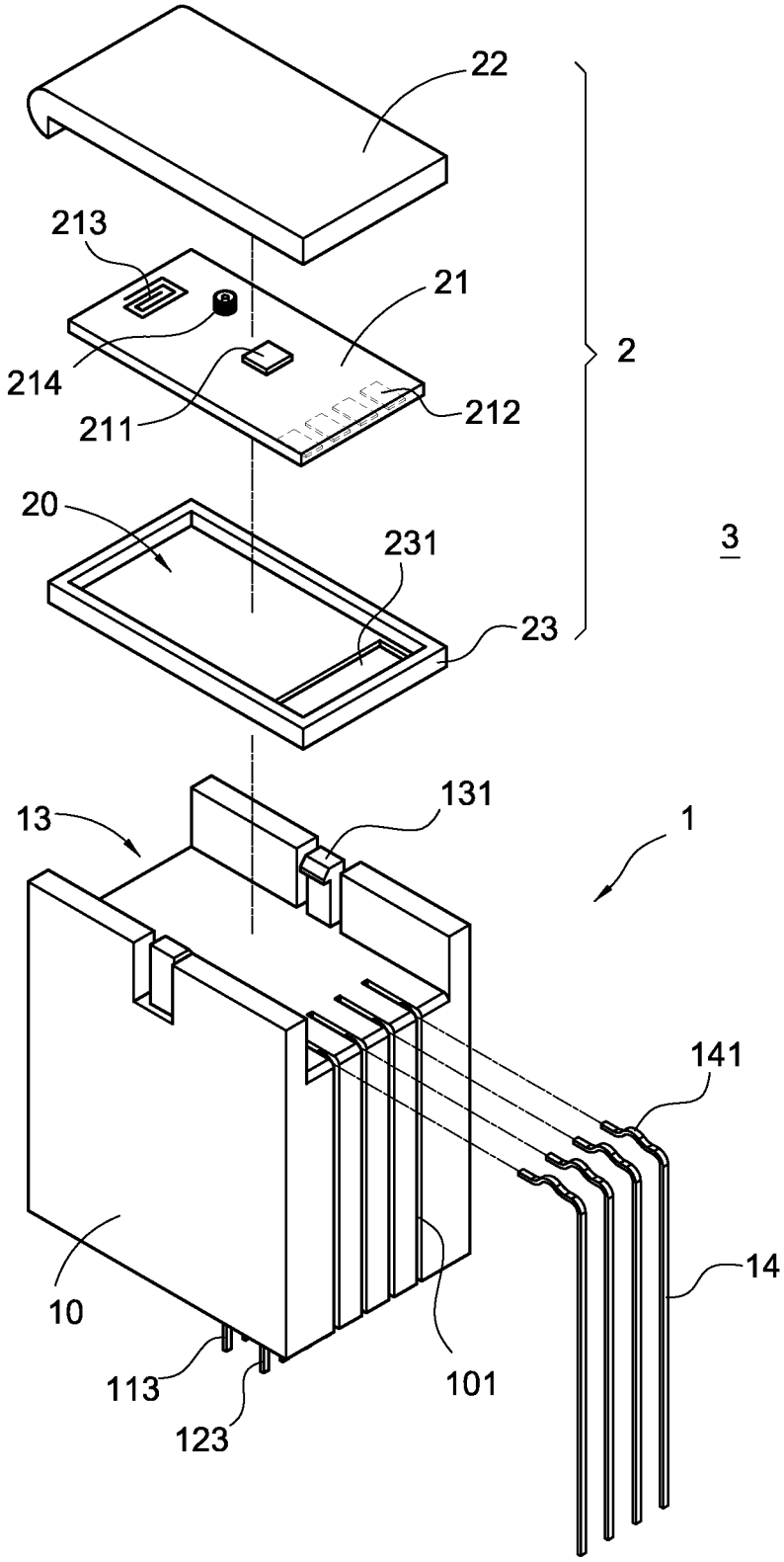
FIG. 1 is an exploded view according to an embodiment of the present invention.
Figure 2:
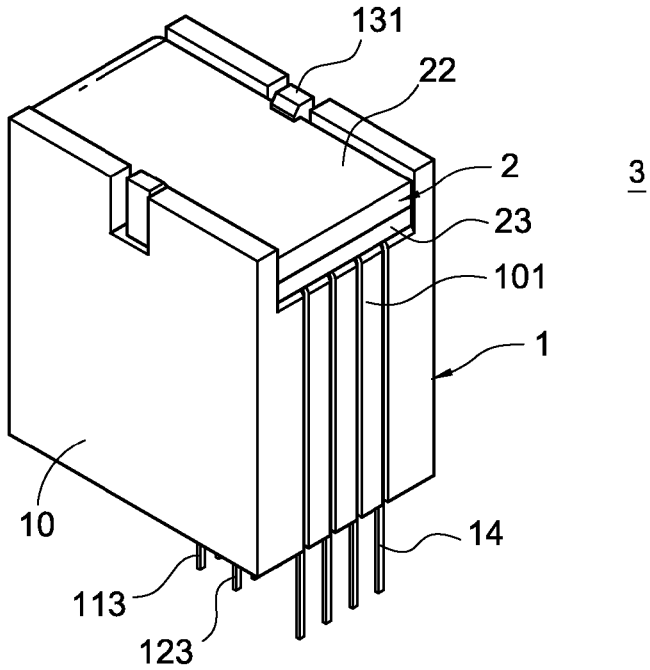
FIG. 2 is a perspective view according to an embodiment of the present invention.
Figure 3:
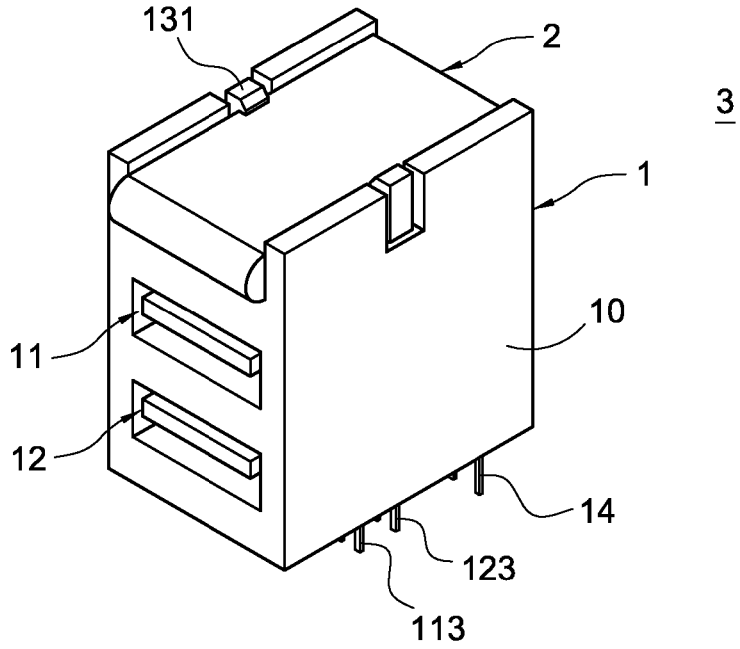
FIG. 3 is another perspective view according to an embodiment of the present invention.
Figure 4:
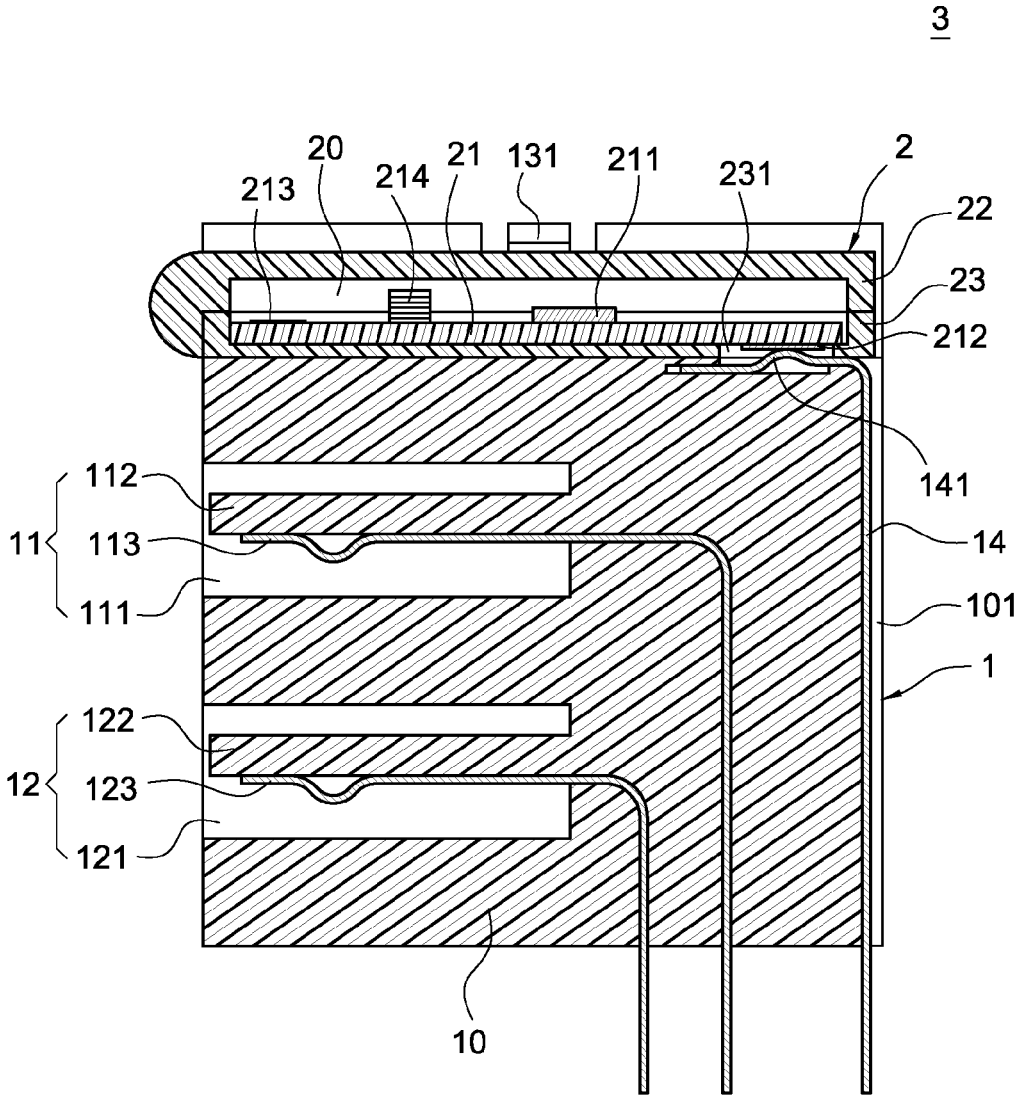
FIG. 4 is a side view according to an embodiment of the present invention.

A detailed description of the present invention will be made with reference to the accompanying drawings.

FIG. 1 to FIG. 4 shows a connector apparatus 3 having a detachable module. The connector apparatus 3 mainly includes a connector base 1 and a detachable module 2.

The connector base 1 has an insulating body 10 and a plurality of press-contacting terminals 14. The insulating body 10 is substantially a shell made by plastic molding. The front surface of the insulating body 10 has two receiving recesses 111 and 112. Each of the receiving recesses has a tongue portion 112 and 122. A plurality of connecting terminals 113 and 123 are respectively arranged on the tongue portion 112 and 122. Connector ports 11 and 12 are respectively composed of receiving recesses 111 and 112, the tongue portions 112, 122 and the connecting terminals 113, 123.

For example, if the number of the connecting terminals 113 in the receiving recess 111 are four. A universal serial bus (USB) connector port 11 is composed of the receiving recess 111, the tongue portion 112 and the connecting terminal 113. In another example, if the number of the connecting terminals 123 in the receiving recess 121 is seven. An external serial advance technology attachment (eSATA) connector port 12 is composed of the receiving recess 121, the tongue portion 122 and the connecting terminals 123. In this embodiment, the number of the connector ports is two for illustration only. The type of the connector port 11, 12 is not limited to USB and the number thereof is not limited to two.

A plurality of grooves are inwardly formed on the rear surface of the insulating body 10. And the press-contacting terminals 14 are correspondingly arranged in the grooves 101. One ends of the press-contacting terminals have a press-contacting portion 141. Each of the press-contacting portions 141 extend along the upper surface of the insulating body 10 and protrude out of the upper surface. More specifically, the positions of press-contacting portions 141 are higher than the upper surface of the insulating body 10. In this embodiment, the number of the press-contacting terminals is four for example and not limited thereto.

The upper surface of the insulating body 10 has a connecting tunnel 13. Two fixing posts 131 are arranged at two sides of the connecting tunnel 13. When the detachable module 2 is connected to the connector base 1, the detachable module 2 can be fixed by the two fixing posts 131 for firmly fixing the detachable module 2.

The detachable module 2 mainly has a circuit board 21, an integrated circuit 211 electrically connected to the circuit board 21, and a plurality of connecting pads 212 (connecting pads and connecting pins are seen have the same meaning herein). The connecting pins 212 are welded to a side of the circuit board 21. The position and the number of the connecting pins 212 are corresponding to the press-contacting terminals 14 of the connector base 1. In this embodiment, the number of the connecting pins 212 is four but not limited thereto. When the connecting pins 212 contact with the press-contacting portion 141 of the press-contacting terminals 14, the detachable module 2 is in electrical connection with the connector base 1.

The connector base 1 is electrically connected to a mainboard of an external computer through the connecting terminals 113, 123 and the press-contacting terminals 14. When the connecting pins 212 contact against the press-contacting portions 141 of the press-contacting terminals 14, the mainboard of the computer is able to execute the function of the integrated circuit 211 of the detachable module 2. In this embodiment, the integrated circuit 211 is a wireless transmission chip, such as a Bluetooth transmission chip, a wireless fidelity (WiFi) transmission chip, radio frequency transmission chip or a third generation transmission chip, but not limited thereto. Thus, the mainboard of the computer can execute wireless internet function through the connector base 1.

The detachable module 2 can further have an antenna unit 213 electrically connected to the circuit board 21. The detachable module 2 can outwardly transmit the wireless signal generated by the wireless transmission chip, or can receive external wireless signal and deliver it to the wireless transmission chip for processing. Moreover, for preventing that the receiving direction of the antenna unit 213 is narrowed to one direction and causes the instability of the transmission intensity of the wireless signal. The detachable module 2 can have an external antenna connector 214 electrically connected to the circuit board 21. The detachable module 2 can be electrically connected to an external antenna (not shown) through the external antenna connector 214. By the external antenna having larger receiving area, wider receiving angle, and better arranging portion, better transmission performance can be obtained.

The detachable module 2 includes a top cover 22 and a bottom cover 23. The top cover 22 and the bottom cover 23 can be correspondingly assembled, and define an accommodating space 20 for accommodating the circuit board 21, the integrated circuit 211 and the connecting pins 212. A side of the bottom cover 23 has at least one opening 231 for passing the connecting pins 212 of the circuit board 21 out of the detachable module 2.

It should be mentioned that when the detachable module 2 is arranged on the connecting tunnel 13, the two fixing posts 131 at two sides of the connecting tunnel 13 can press and hold the two sides of the top cover 22.

Figure 6:
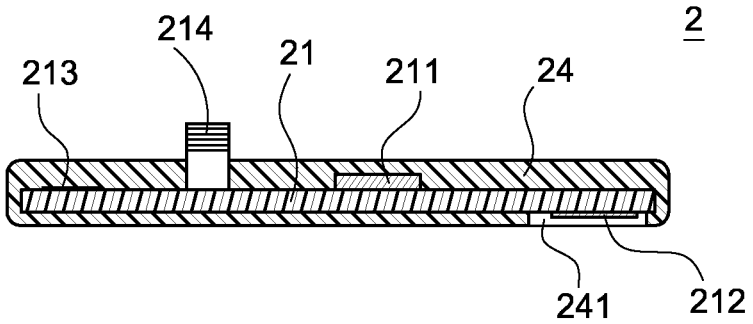
FIG. 6 is a perspective view of a detachable module according to another embodiment of the present invention.

FIG. 6 shows another detachable module according to another embodiment of the present invention. The detachable module 2 does not have the top cover 22 and the bottom cover 23 for accommodating the circuit board 21 and the integrated circuit 211. The detachable module 2 can have an encapsulator 24 made by plastic injection molding. The encapsulator 24 encapsulates the circuit board 21, the integrated circuit 211 and the connecting pins 212. Thus, the thickness of the detachable module 2 can be appropriately decreased for saving space. A side of the encapsulator 24 has at least one opening 241 for passing through the connecting pins 212 of the circuit board 21 out of the detachable module 2. More specifically, the connecting pins 212 pass through the opening 241 and protrude out of the detachable module 2 and contact with the press-contacting portions 141 of the press-contacting terminals 14.

Figure 5:
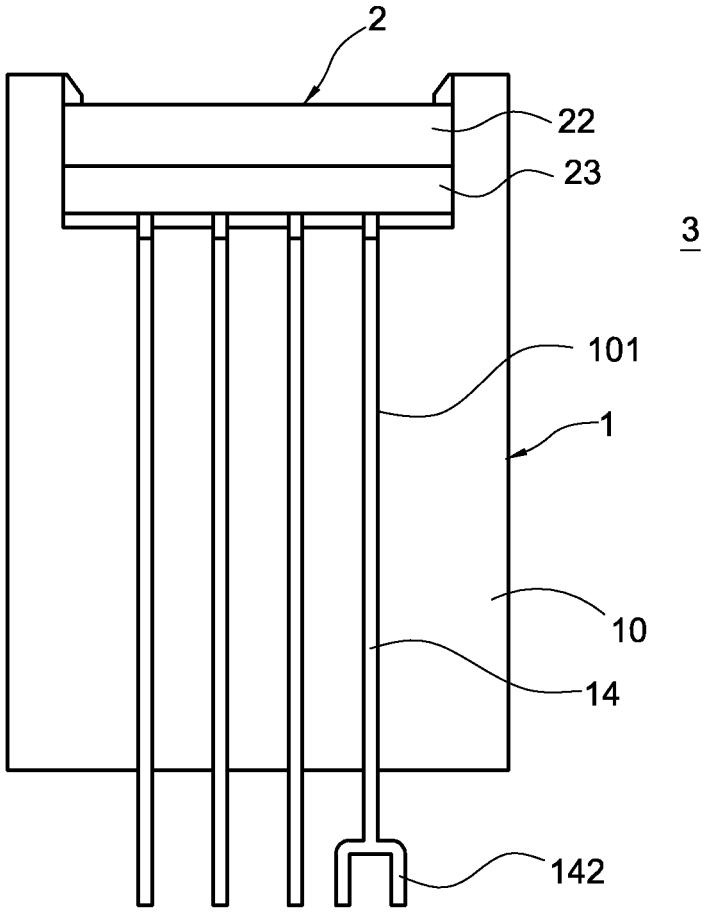
FIG. 5 is a rear view according to an embodiment of the present invention.

As FIG. 5 shows, one end of the press-contacting terminal 14 can be a Y-shaped end 142. The press-contacting terminal 14 can be electrically connected to more then one grounding lines through the Y-shaped end 142. The connector apparatus 3 having the press-contacting terminals 14 will be more stable.

Figure 7:
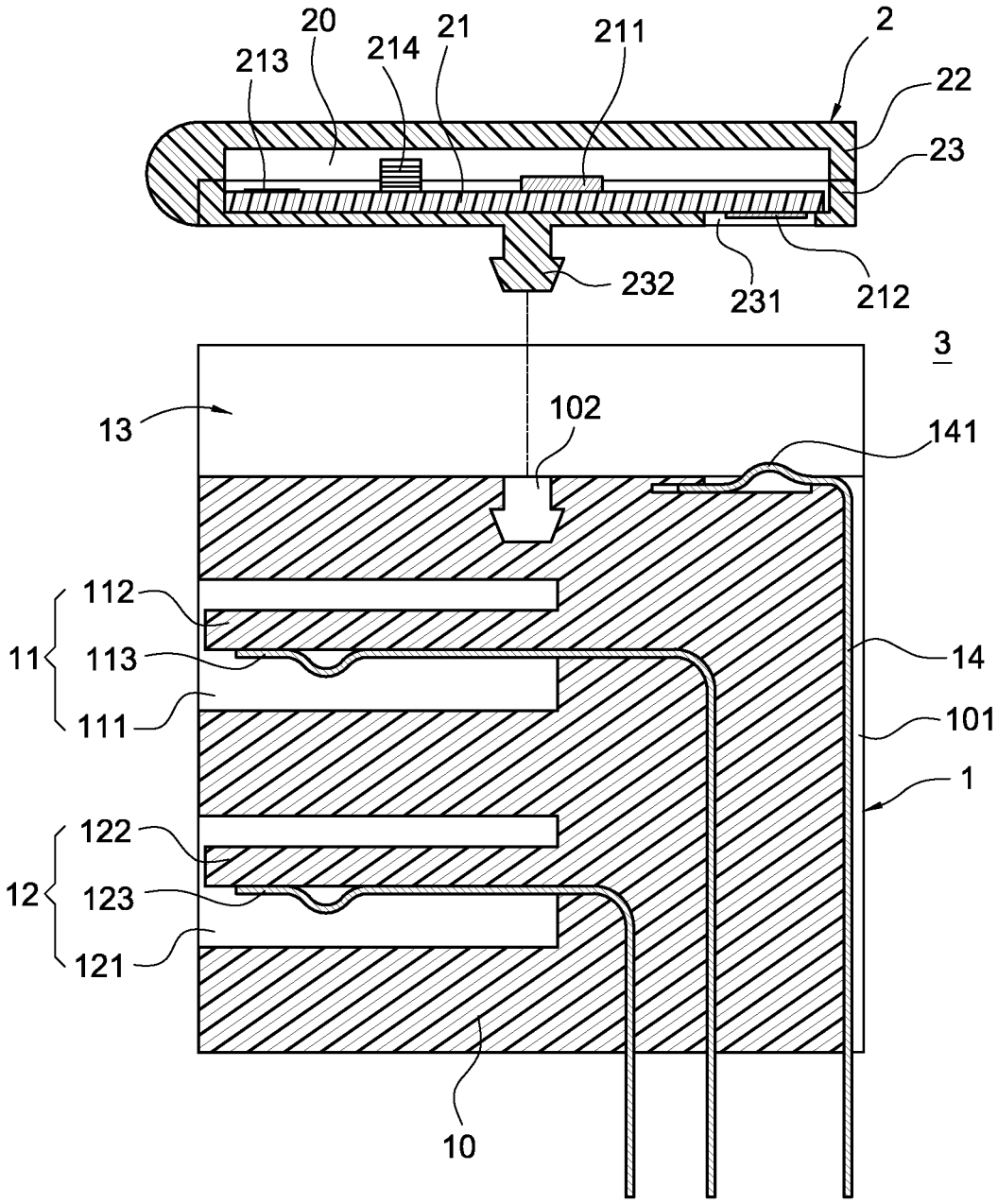
FIG. 7 is a perspective view according to another embodiment of the present invention.

As FIG. 7 shows, a positioning post 232 is arranged on the bottom surface of the bottom cover 23 of the detachable module 2. A positioning groove 102 is formed on the top surface of the insulating body 10. The position and the shape of the positioning groove 102 are corresponding to the positioning post 232. When the detachable module 2 is arranged in the connecting tunnel 13 of the connector base 1, the connecting pins 212 are electrically contacted with the press-contacting portions 141 of the press-contacting terminals 14, and the positioning post 232 is inserted in the positioning groove 102. Thus, the detachable module 2 is firmly fixed on the connector base 1. More specifically, the positioning post 232 is of anchor-shape and the positioning groove 102 is also of anchor-shape.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A connector apparatus having a detachable module comprising:

a connector base having an insulating body and a plurality of press-contacting terminals, at least one receiving recess being formed on a front surface of the insulating body, the receiving recess having a tongue portion and a plurality of connecting terminals, a plurality of grooves being inwardly formed on a rear surface of the insulating body, the press-contacting terminals being correspondingly located in the grooves, a press-contacting portion of each of the press-contacting terminals extending along an upper surface of the insulating body and protruding out from the upper surface and having higher position than a top surface of the insulating body; and a detachable module comprising a circuit board, an integrated circuit electrically connecting to the circuit board, and a plurality of connecting pads arranged on the circuit board, the connecting pads being arranged at a side of the circuit board, and the position and the number of the connecting pads correspond to the press-contacting terminals of the connector base, the detachable module is electrically connected to the press-contacting terminals of the connector base through the connecting pads.

2. The connector apparatus as claim 1, wherein the number of the connecting pins is four and the number of the press-contacting terminals is four.

3. The connector apparatus as claim 2, wherein the connecting pins of the detachable module contact and electrically connect with the press-contacting portions of the press-contacting terminals.

4. The connector apparatus as claim 1, wherein the number of the connecting terminals is four, and the receiving recess, the tongue portion, and the connecting terminals constitute a USB connecting port.

5. The connector apparatus as claim 1, wherein the number of the connecting terminals is seven, and the receiving recess, the tongue portion, and the connecting terminals constitute an eSATA connecting port.

6. The connector apparatus as claim 1, wherein a connecting tunnel is formed on the top surface of the insulating body, two fixing posts are formed at two sides of the connecting tunnel, the detachable module is arranged in the connecting tunnel, and the two fixing posts are used for fixing the detachable module.

7. The connector apparatus as claim 6, wherein the detachable module has a top cover and a bottom cover, the top cover and the bottom cover are correspondingly assembled and define a accommodating space for accommodating the circuit board, the integrated circuit, and the connecting terminals, an opening is formed on a side of the bottom cover for passing through the connecting pins out of the detachable module.

8. The connector apparatus as claim 7, wherein the two fixing posts at the two sides of the connecting tunnel for pressing and holding the two sides of the top side of the detachable module.

9. The connector apparatus as claim 7, wherein a positioning post is formed on the bottom surface of the bottom cover, and a positioning recess is inwardly formed on the top surface of the top surface of the insulating body, when the connecting pins are electrically connected with the press-contacting terminals, the positioning posts are inserted in the positioning recess.

10. The connector apparatus as claim 9, wherein the positioning post is of anchor shape and the positioning recess is of anchor shape and the position and number of the positioning posts corresponds to the positioning posts.

11. The connector apparatus as claim 6, wherein the integrated circuit is a wireless transmission chip.

12. The connector apparatus as claim 11, wherein the wireless transmission chip is Bluetooth transmission chip.

13. The connector apparatus as claim 11, wherein the wireless transmission chip is Wi-Fi transmission chip.

14. The connector apparatus as claim 11, wherein the wireless transmission chip is RF transmission chip.

15. The connector apparatus as claim 11, wherein the wireless transmission chip is third generation transmission chip.

16. The connector apparatus as claim 11, wherein the detachable module further comprises an antenna unit electrically connected to the circuit board for receiving or transmitting wireless signals.

17. The connector apparatus as claim 11, wherein the detachable module further comprises an external antenna connector electrically connecting to the circuit board for connecting an external antenna.

18. The connector apparatus as claim 6, wherein the detachable module has a encapsulator made by injection molding for encapsulating the circuit board, the integrated circuit and the connecting pins, an opening is formed on a side of the encapsulator for passing through connecting pins of the circuit board out of the detachable module.

19. The connector apparatus as claim 6, wherein at least one end of the press-contacting terminals is a Y-shape, for electrically connecting multiple grounding lines of a mainboard of an external computer.

* * * * *